US011679315B2

(12) United States Patent
Wisnom

(10) Patent No.: US 11,679,315 B2
(45) Date of Patent: Jun. 20, 2023

(54) GOLF ACCESSORY

(71) Applicant: Scott Wisnom, New Market, MD (US)

(72) Inventor: Scott Wisnom, New Market, MD (US)

( * ) Notice: Subject to any disclaimer, the term of this patent is extended or adjusted under 35 U.S.C. 154(b) by 408 days.

(21) Appl. No.: 16/839,531

(22) Filed: Apr. 3, 2020

(65) Prior Publication Data

US 2020/0316442 A1 Oct. 8, 2020

Related U.S. Application Data

(60) Provisional application No. 62/829,758, filed on Apr. 5, 2019.

(51) Int. Cl.
*A63B 55/00* (2015.01)

(52) U.S. Cl.
CPC ..... *A63B 55/408* (2015.10); *A63B 2209/10* (2013.01)

(58) Field of Classification Search
CPC ..... A45C 11/182
USPC ..... 206/315.3; 150/154
See application file for complete search history.

(56) References Cited

U.S. PATENT DOCUMENTS

| | | | | |
|---|---|---|---|---|
| 2,820,498 | A * | 1/1958 | Endee | A63B 55/408 224/608 |
| D347,542 | S * | 6/1994 | Sheppard, Jr. | D6/608 |
| 5,771,523 | A | 6/1998 | Rudolph | |
| 5,870,023 | A * | 2/1999 | Jackson | A63B 55/00 206/315.3 |
| 5,911,311 | A | 6/1999 | Hutchins | |
| 6,434,800 | B1 * | 8/2002 | James | A63B 60/62 24/298 |
| 7,152,279 | B2 | 12/2006 | Elliott | |
| 7,409,726 | B2 | 8/2008 | Bahm et al. | |
| 7,458,405 | B1 | 12/2008 | Gaffney | |
| D656,431 | S | 3/2012 | Bekker | |
| 8,307,489 | B1 | 11/2012 | Adame | |
| D675,806 | S * | 2/2013 | Caul | D2/500 |
| 8,491,191 | B2 | 7/2013 | Ackerman et al. | |
| 8,701,216 | B1 | 4/2014 | Evans | |
| 9,216,342 | B1 | 12/2015 | Evans | |
| 9,717,966 | B1 * | 8/2017 | Queener | F16M 13/02 |
| 10,034,502 | B2 * | 7/2018 | Elliott | A41D 19/0041 |
| 10,154,723 | B2 * | 12/2018 | Kreutzer | A45F 3/20 |
| 11,051,595 | B1 * | 7/2021 | Yim | A45F 5/00 |
| 2002/0138953 | A1 | 10/2002 | Passafiume | |
| 2002/0145095 | A1 | 10/2002 | Winkler | |

(Continued)

OTHER PUBLICATIONS

Original Bushwhacker Portable speaker mount for golf cart by Bushwhacker—available for sale on Amazon.com https://www.amazon.com/Bushwhacker-Portable-Speaker-Mount-Railing/product-reviews/B07K2HX69H/ref=cm_cr_getr_d_paging_btm_next_33?ie=UTF8&reviewerType=all_reviews&sortBy=recent&pageNumber=33 (Year: 2019).*

*Primary Examiner* — Jennifer Robertson
*Assistant Examiner* — Jessica Kavini Tamil
(74) *Attorney, Agent, or Firm* — Edell, Shapiro & Finnan, LLC

(57) ABSTRACT

A kit of golf accessories including an attachment device is disclosed. The attachment device may include a grip portion and a plurality of first engagement members. The grip portion is configured to frictionally engage the elongate support of the golf travel device when the attachment device is wrapped around and secured to the elongate support. The plurality of first engagement members are arranged in longitudinal alignment on a front surface that is opposite the grip portion.

19 Claims, 14 Drawing Sheets

(56) References Cited

U.S. PATENT DOCUMENTS

| | | | | |
|---|---|---|---|---|
| 2006/0006300 | A1 | 1/2006 | Reason | |
| 2007/0267454 | A1* | 11/2007 | Baiz | A45C 5/06 224/576 |
| 2008/0047639 | A1 | 2/2008 | Fox | |
| 2009/0302083 | A1* | 12/2009 | Eisele | A63B 57/203 224/684 |
| 2013/0212898 | A1* | 8/2013 | Reynolds | A45C 13/30 34/239 |
| 2015/0074930 | A1 | 3/2015 | Lebwohl et al. | |
| 2015/0174462 | A1* | 6/2015 | Loudenslager | A63B 55/60 206/315.3 |
| 2019/0298028 | A1* | 10/2019 | Haack | A45C 13/262 |

* cited by examiner

GOLF ACCESSORY

CROSS-REFERENCE TO RELATED APPLICATIONS

This application claims priority under 35 U.S.C. § 119(e) to U.S. Provisional Patent Application Ser. No. 62/829,758, entitled "Golf Accessory Organizer," filed Apr. 5, 2019, the disclosure of which is incorporated herein by reference in its entirety for all purposes.

FIELD OF INVENTION

The present application relates to the field of golf equipment and, in particular, to organizing and improving access to golf accessories during golf play.

BACKGROUND

During play, a golfer often needs a number of accessories, such as golf tees, golf balls, ball markers, towels, golf gloves, divot repair tools, scorecards, yardage books, etc. In fact, as golf technology improves, more and more accessories are becoming available to golfers, such as laser range finders, swing trackers, devices with global positioning system (GPS), etc. These tech accessories may be expensive and may also be larger than standard golf accessories and equipment (e.g., too large for a pocket). Moreover, a golfer often carries these accessories while also carrying their personal belongings (e.g., a phone, keys, and wallet) and/or food and drink for consumption during play.

Often, golfers carry many of the smaller accessories (e.g., tees and balls) in their pockets; however, this can be uncomfortable and can mix the accessories together, making it hard to find a specific accessory (e.g., a ball marker), especially if the golf accessories are mixed with personal belongings. This may also damage or dirty personal belongings. Additionally or alternatively, a golfer may store accessories in their golf bag, pull cart, and/or golf cart. However, it may also be difficult to find specific golf accessories stored in/on a golf bag, a pull cart, and/or a golf cart, as items can often move around when stored in the pockets or compartments of a golf bag, pull cart, and/or golf cart. Accessories or personal belongings can also easily fall out of open compartments on a golf cart or pull cart and/or can be dirtied/contaminated by food or drunk stored nearby. In view of at least the aforementioned issues, devices and methods for organizing or improving access to golf accessories are desired.

SUMMARY

The present application provides a device, a kit, and a method for organizing and improving access to golf accessories. In particular, the device, kit, and method presented herein organize golf accessories so that the golf accessories are easily accessible, but safely stored during golf play (e.g., during and between shots).

For example, according to an embodiment, the present application provides a kit of golf accessories, the kit including an attachment device and a bag accessory. The attachment device is sized to wrap around and removably engage an elongate support of a golf travel device (e.g., a stanchion of a golf cart, a handle of a pull cart, etc.) and includes a grip portion and a plurality of first engagement members. The grip portion is configured to frictionally engage the elongate support of the golf travel device when the attachment device is wrapped around and secured to the elongate support. The plurality of first engagement members are arranged in longitudinal alignment on the front surface. The bag accessory includes a closed bottom and sides that define a receptacle. The bag accessory also includes a second engagement member configured to engage with one of the plurality of first engagement members.

In at least some of these embodiments, the grip portion of the attachment device is or is coated with a rubber material that has that provides frictional resistance against metal, wood, and plastic, and the rubber material has a thickness in a range between 0.2 mm and 1.0 mm, inclusive of 0.2 mm and 1.0 mm. Additionally or alternatively, the attachment device may include a front surface and a back surface. The back surface may include the grip portion and may also including a fastening portion configured to removably mate with a portion of the front surface to removably secure the attachment device on and around the elongate support.

In some embodiments, the second engagement member of the bag accessory is included on a strap that is removably coupled to one or more fabric loops that extend from the sides or a top rim of the bag accessory. The top rim may be stiff or resilient to bias the receptacle, which may be an open-top receptacle, to an open position so that it is easy to find accessories stored therein. Additionally or alternatively, the kit may also include one or more towel accessories and/or one or more strap accessories.

A towel accessory may include a third engagement member configured to engage with one of the plurality of first engagement members and the third engagement member may be irremovable from the towel accessory. In some instances, the third engagement member is included in a corner of a towel accessory. In other instances, the third engagement member is included at a midpoint of an edge of a towel accessory. The corner location may make a majority of a towel available for easy use and a midpoint location may cause a larger towel to naturally fold in half.

A strap accessory also includes a third engagement member configured to engage with one of the plurality of first engagement members, and the third engagement member is also irremovable from the strap accessory. In some instances, the strap accessory includes a mating area, a first end, and a second end. The first end defines a loophole and the second end can be inserted through the loophole and folded back onto the mating area to mate with the mating area and define a closed loop of adjustable size. In other instances, the strap accessory defines an unopenable closed loop of a fixed size through which additional accessories may be installed. These straps may allow a variety of accessories and equipment that do not include engagement members to be stored on or supported by the kit presented herein.

According to another example embodiment, the present application provides a device for organizing a plurality of golf accessories. The device includes a front surface with a first mating element, a back surface, and a plurality of first engagement members. The back surface includes a grip portion configured to wrap around an elongate support of a golf travel device and a fastening portion. The fastening portion includes a second mating element configured to removably mate with the first mating element to removably secure the grip portion in frictional engagement with the elongate support of the golf travel device. The plurality of first engagement members are arranged in longitudinal alignment on the front surface and are configured to removably support a variety of golf accessories that include or are supported in attachable accessories with at least one second engagement member that can removably engage at least one of the plurality of first engagement members.

In at least some of these embodiments, the first mating element comprises a bed of loop material or a bed of hook material and the second mating element comprises the other of the bed of loop material or the bed of hook material, so that the first mating element can removably mate with the second mating element. For example, in some instances, the first mating element comprises the bed of loop material, but with portions of hook material embedded therein so that the first mating element can mate with the second mating element and also removably engage additional beds of the loop material.

In at least some of these embodiments, the plurality of first engagement members includes male portions of standard ⅜ inch snaps and the at least one second engagement member is a female portion of the standard ⅜ inch snap. Additionally or alternatively, the plurality of first engagement members may be approximately laterally centered on the front surface. For example, if the attachment device has a lateral dimension of approximately 7.375 inches, the plurality of first engagement members may be disposed approximately 3.75 inches from a lateral edge of the attachment device.

Still further, in some of these embodiments, the device may further comprise an installation strap that extends from and laterally beyond the back surface. The installation strap includes a third mating element that can removably mate with the first mating element or the second mating element to temporarily secure device around the elongate support of the golf travel device. Due to its lateral extension beyond the back surface, the installation strap may provide more slack than is available while mating the first mating element to the second mating element.

According to yet another embodiment, embodiments of the present application provide a device for organizing a plurality of golf accessories that includes an attachment component and a bag component. The attachment component includes a first mating element, a grip portion, and a fastening portion with a second mating element. The grip portion is configured to wrap around an elongate support of a golf travel device. The second mating element is configured to removably mate with the first mating element to removably secure the grip portion in frictional engagement with the elongate support of the golf travel device around which it is wrapped. The bag component includes a closed bottom and at least one sidewall that define a receptacle. Thus, the device may provide a pouch for golf accessories that can be removably attached to a variety of golf travel devices to provide easy access to golf accessories, equipment, and/or personal belongings. In at least some of these embodiments, the bag component is irremovably connected to the attachment component.

According to yet another example, embodiments of the present application provide a method of organizing a plurality of golf accessories. The method includes providing an attachment device including a front surface with a mating portion and a plurality of first engagement members arranged in longitudinal alignment disposed thereon, and a back surface including a grip portion and a fastening portion configured to removably mate with the mating portion of the front surface. The back surface is wrapped around an elongate support of a golf travel device and, then, the back surface is secured around the elongate support by connecting the fastening portion of the back surface to the mating portion of the front surface. The securing causes the grip portion of the back surface to frictionally engage the elongate support. Attachment accessories with one or more second engagement members can be secured to the to one or more engagement members of the plurality of first engagement members to support or provide support for golf accessories on the elongate support of the golf travel device.

In some of these embodiments, the attachment device further comprises an installation strap and the method further includes, prior to the securing of the back surface around the elongate support, temporarily securing the attachment device around the elongate support by connecting the installation strap to the mating portion of the front surface. The installation strap extends from and laterally beyond the back surface so that the installation strap provides more slack than is available while connecting the fastening portion of the back surface to the mating portion of the front surface.

BRIEF DESCRIPTION OF THE DRAWINGS

To complete the description and in order to provide for a better understanding of the present application, a set of drawings is provided. The drawings form an integral part of the description and illustrate embodiments of the kit and devices presented herein, which should not be interpreted as restricting the scope of the application, but just as an example. The drawings comprise the following figures.

DETAILED DESCRIPTION

Figure 1:
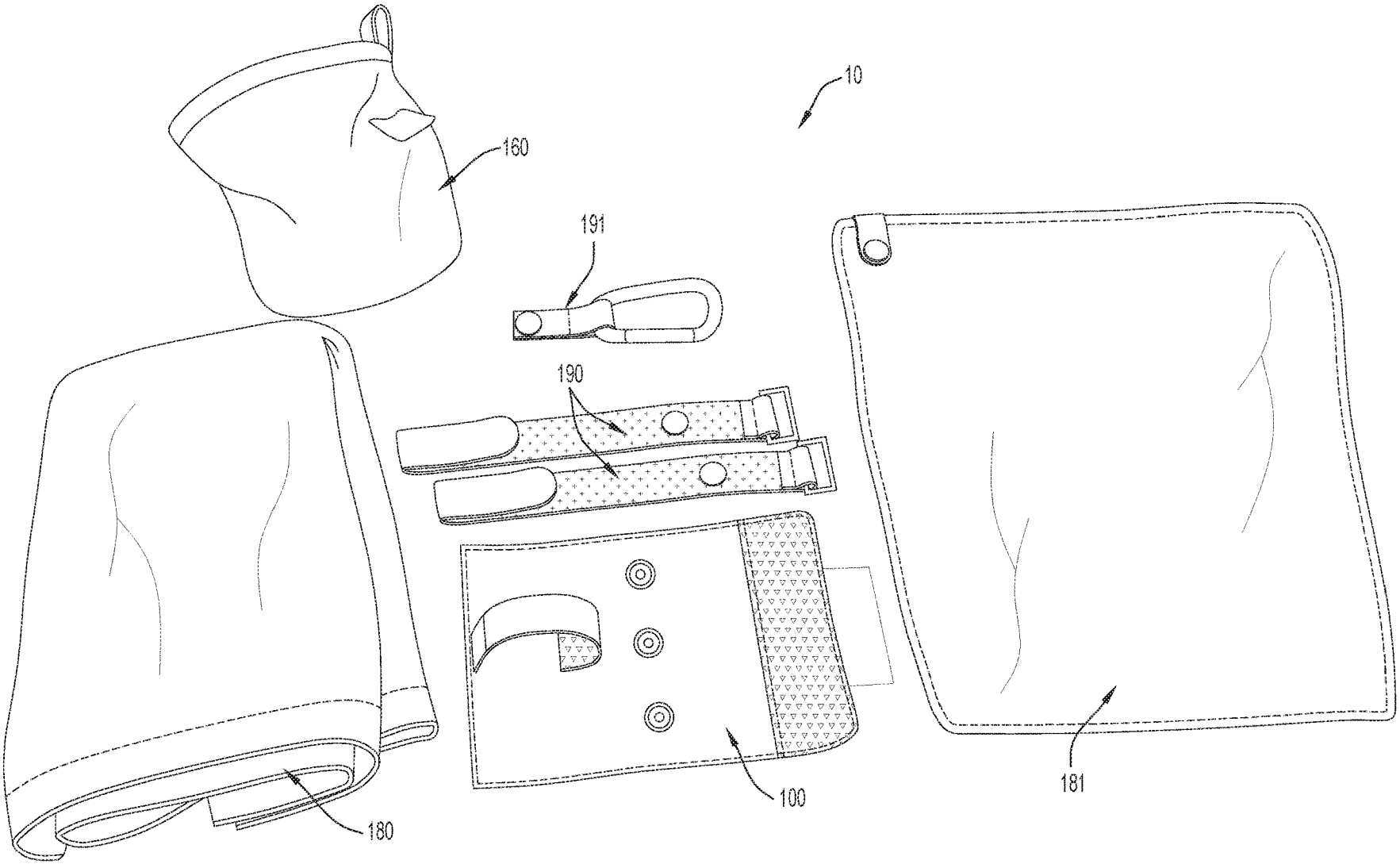
FIG. 1 is a perspective view of a kit of golf accessories according to an exemplary embodiment presented herein.

The following description is not to be taken in a limiting sense but is given solely for describing broad principles of the present application. Embodiments will be described by way of example, with reference to the above-mentioned drawings.

Generally, the kit, accessories, and method presented herein organize and improve access to common golf accessories used while playing a round of golf. That is, the present application is drawn to apparatuses and techniques that keep golf accessories easily accessible during and between golf swings. To that end, the kit presented herein includes an attachment device with a one or more first engagement members (e.g., male portions of snaps) that is mountable or installable onto a golf travel device, insofar as the term "golf travel device" is intended to denote any apparatus that assists a user and/or his/her clubs with travel during a round of golf, a practice session, etc. For example, a golf travel device may include a golf cart, a pull-cart, a scooter/standing golf cart, etc. The attachment device can be mounted or installed on an elongate support included on the golf travel device, such as a roof support stanchion of a golf cart or a grip or handle of a pull cart. Alternatively, the attachment device could be formed integrally with an elongate support of a golf travel device (e.g., an attachment device could be integrated into a stanchion of a golf cart before or as the golf cart is assembled).

Regardless of how the attachment device is coupled to an elongate member of a golf travel device, once the attachment device is mounted/installed, the one or more first engagement members (e.g., male portions of snaps) provide connection points onto which various attachment accessories of the kit presented herein may be connected. Example attachment accessories that can connect to the connection points provided by the one or more first engagement members include towels, a bag accessory, and straps, each of which may include one or more second engagement members (e.g., female portions of snaps) that can removably connect to any number of the one or more first engagement members (e.g., male portions of snaps).

In turn, the attachment accessories included in the golf kit presented herein may hold or support a wide variety of golf equipment, accessories, and items typically present during golf. For example, the bag accessory presented herein may hold a collection of golf tees, golf balls, divot repair tools, and/or other small items. Additionally or alternatively, the bag accessory presented herein may hold larger items, such as a yardage book, a range finder, or other such items. As another example, the strap accessories presented herein may support additional accessories, such as umbrellas or clubs, as well as club holders, carabineers, or other such attachment mechanisms that allow for further connection to yet other items. For example, two straps might secure an umbrella against a golf cart stanchion while a third strap supports a golf club holder to hold a player's putter beneath the umbrella.

Now referring to FIG. 1, an example golf accessories kit 10 includes an attachment device 100 and six additional attachment accessories. In particular, golf accessories kit 10 includes a bag accessory 160, a first towel accessory 180, a second towel accessory 181, two first strap accessories 190, and a second strap accessory 191. As is explained in further detail below, these various attachment accessories may be coupled to the attachment device 100 in various combinations and configurations to support a plethora of golf equipment, golf accessories (e.g., tees, golf balls, etc.), and/or personal belongings. Moreover, although golf accessories kit 10 is depicted with six attachment accessories, in other embodiments, the golf accessories kit 10 may include the attachment device 100 and one or more additional attachment accessories. For example, a golf accessories kit 10 could include attachment device 100 and the bag accessory 160.

Figure 6:
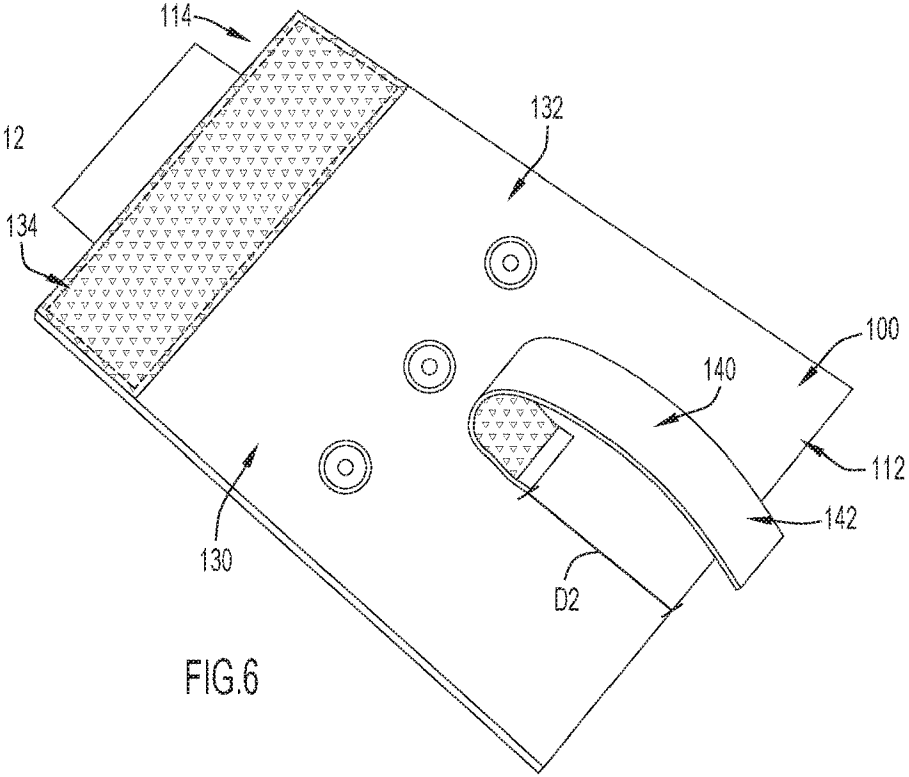
FIGS. 5 and 6 are back perspective views of the attachment device of FIG. 2.
Figure 7A:
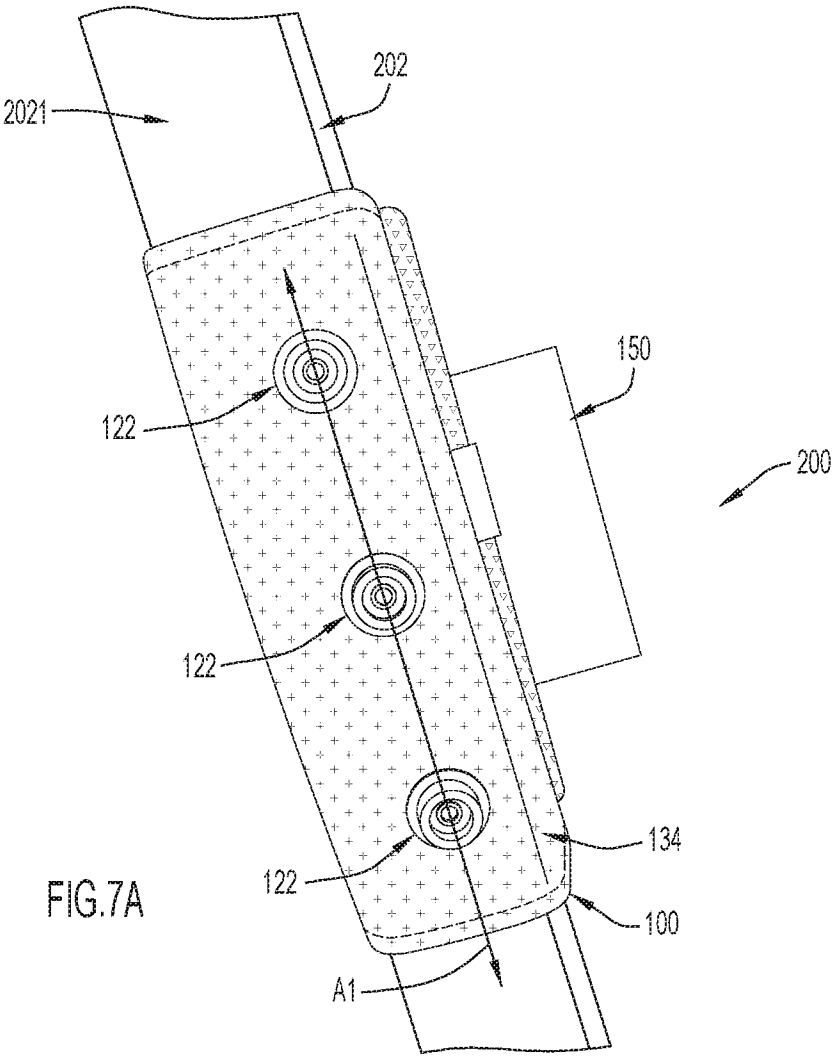
FIG. 7A is a front perspective view of the attachment device of FIG. 2 while secured on an elongate support of a golf travel device.

Now turning to FIGS. 2-7B, the attachment device 100 presented herein provides a coupling between the attachment accessories of golf accessories kit 10 and a golf travel device 200 (see, e.g., FIG. 7A). Generally, this is achieved by tightening the attachment device 100 around and against an elongate support 202 of the golf travel device 200. Although support 202 is depicted as a roof support stanchion of a golf cart in the Figures, the elongate support may be a variety of elongate supports, as mentioned above.

Figure 3:
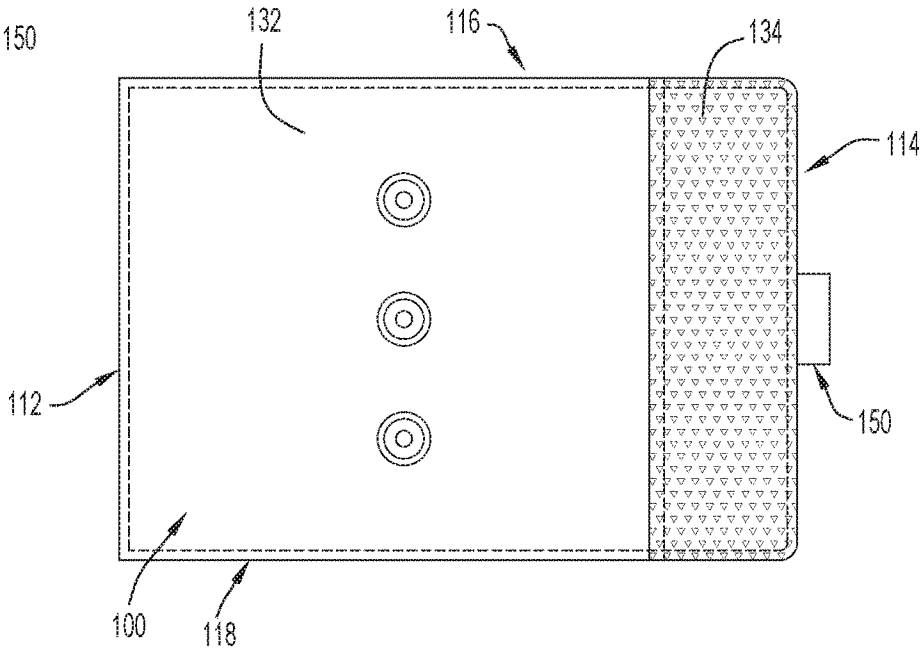
FIG. 3 is a back view of the attachment device of FIG. 2.
Figure 2:
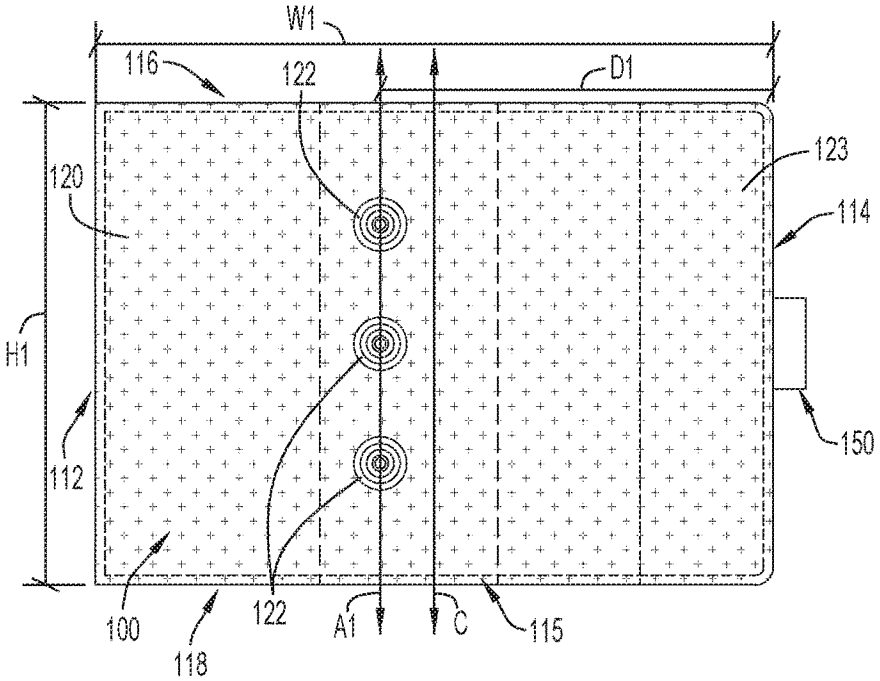
FIG. 2 is a front view of an attachment device included in the kit of golf accessories depicted in FIG. 1.

Now turning specifically to FIGS. 2 and 3, in the depicted embodiment, the attachment device 100 is a substantially rectangular, planar device, that extends from a first lateral side 112 (e.g., a left side) to a second lateral side 114 (e.g., a right side). The first lateral side 112 and second lateral side 114 define a width W1 (i.e., a lateral dimension) of the attachment device 100. Often, golf carts have a standard stanchion size and, thus, in many embodiments, the width W1 may be the same (but need not be). For example, many golf cart roof support stanchions have a square cross section defined by 1 inch or 1.5 inch sides (to define a perimeter of 4 or 6 inches, respectively). Thus, many embodiments of the attachment device 100 may have a width W1 of approximately 7.375 inches to ensure that the attachment device 100 can be wrapped around and tightened against at least a majority of common stanchions. Alternatively, the width W1 may be anywhere in a range of approximately 7-8 inches, approximately 6-9 inches, or approximately 5-10 inches.

The attachment device 100 also has a top 116 and a bottom 118 that define a height H1 of the attachment device 100. The height H1 may vary across various embodiments, but should be large enough to allow adequate longitudinal spacing for first engagement members 122 that are accessible from a front surface 120 of the attachment device 100. For example, if the attachment device 100 includes three first engagement members 122, height H1 may be approximately 5 inches to allow first engagement members 122 to be spaced at least one inch from the top 116, one inch from the bottom 118, and at least 1.5 inches from each other.

Additionally or alternatively, the height H1 may correspond to the width W1, since certain widths may correspond to different weight capacities and be determinative of, or at least impact, the number of first engagement members 122 that can be included on the attachment device 100. For example, if the attachment device 100 has a width W1 of approximately 7.375 inches, height H1 may be approximately 5 inches to allow for a column of three first engagement members 122. That all said, in various embodiments, it is conceivable that the attachment device 100 may have any height H1 in a range of approximately 6-7 inches, approximately 5-8 inches, or approximately 3-12 inches.

Still referring to FIGS. 2 and 3, regardless of the dimensions of attachment device 100, the attachment device 100 includes a front surface 120 and a back surface 130. As mentioned, the front surface 120 includes a one or more first engagement members 122 (and a plurality of first engagement members 122 in at least some embodiments). In the depicted embodiment, first engagement members 122 are three male portions of ⅜ inch snaps. However, in other embodiments, first engagement members 122 could be or include any male or female engagement member now known or developed hereafter, such as a magnet of a specific polarity, a bed of loops and/or hooks, etc. Moreover, in other embodiments, the first engagement members 122 can include any number of engagement members.

In the depicted embodiment, the attachment device 100 includes a single column of first engagement members 122, which are longitudinally spaced and aligned between the top 116 and the bottom 118. That is, the first engagement members 122 are aligned on a longitudinal axis A1 that extends perpendicular to the top 116 and the bottom 118. In at least some embodiments, the longitudinal axis A1 is centrally aligned with respect to the width W1 of the attachment device 100, insofar as "centrally aligned" is intended to mean that the longitudinal axis A1 is disposed in a central region 115 of the attachment device 100 (the central region 115 is denoted with dashes in FIG. 2). In the depicted embodiment, the central region 115 is a one-inch wide columnar swath of the attachment device 100 centered around a central longitudinal axis C of the attachment device 100 (central axis C being aligned with the midpoint of width W1). However, in other embodiments, the central region may have other dimensions (e.g., span a different width about the central axis C).

As a specific example, in the depicted embodiment, width W1 is approximately 7.375 inches and longitudinal axis A1 is spaced from the second lateral side 114 by a distance D1 of approximately 3.75 inches. Thus, the longitudinal axis A1 is disposed in the central region 115, which spans 0.5 inches in either directions from the central axis C, which is disposed approximately 3.6875 inches from both the second lateral side 114 and the first lateral side 112 (with FIG. 2 not necessarily being to scale, but demonstrating this arrangement at a high-level). As is discussed in further detail below, this spacing and dimensioning may ensure that the first engagement members 122 are aligned with a face of an elongate support 202 of a golf travel device 200, instead of a corner of the support 202, when the attachment device 100 is mounted thereon. Moreover, this spacing and dimensioning may ensure that the attachment device 100 does not cover the first engagement members 122 when the attachment device 100 is wrapped around the elongate support 202.

That said, other embodiments may include first engagement members 122 that are not centrally located on the attachment device 100, either in addition to or in lieu of first engagement members 122 aligned on a longitudinal axis A1 disposed in the central region 115. For example, other embodiments may include two or more columns of first engagement members 122, with only one column disposed in the central region 115 (e.g., with the other columns spaced to align with additional faces of a square elongate support 202). Additionally or alternatively, other embodiments can include a column of first engagement members 122 in the central region 115 and one or more additional first engagement members 122 disposed outside the central region 115, not in a columnar arrangement.

Figure 4:
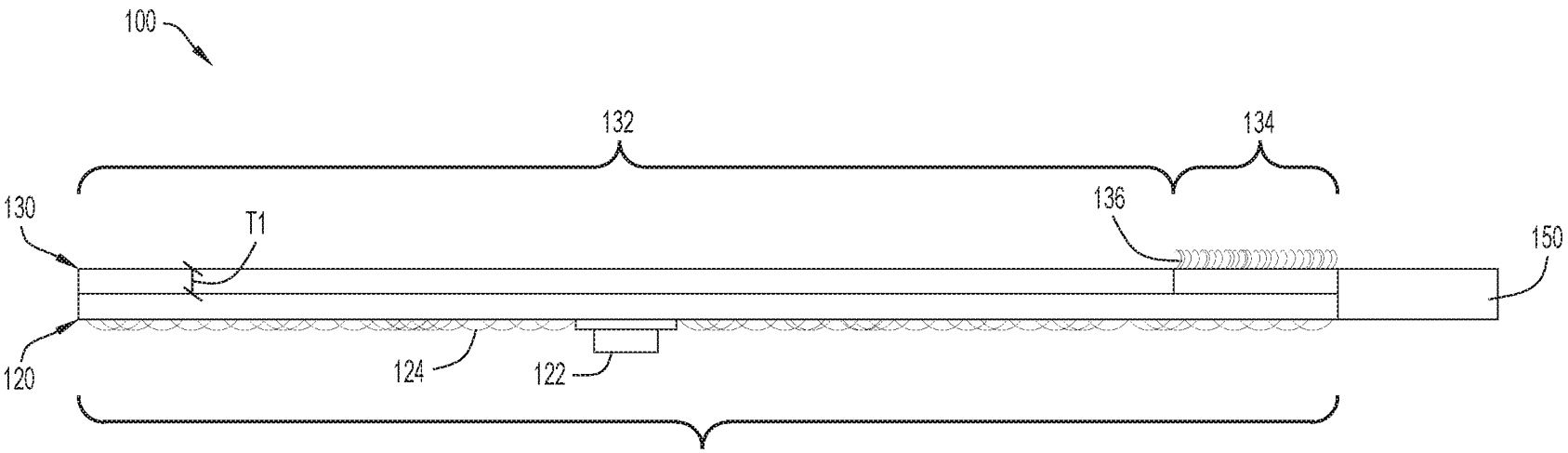
FIG. 4 is a sectional view of the attachment device of FIG. 2.

Still referring to FIGS. 2 and 3, but now with reference to FIG. 4 as well, the front surface 120 of the attachment device 100 is configured to mate with at least a portion of the back surface 130 to secure the first engagement members 122 along an elongate support 202 of a golf travel device 200. Specifically, the front surface 120 includes a first mating element 124 and the back surface 130 includes a fastening portion 134 with a second mating element 136 that can removably mate with the first mating element 124. In the depicted embodiment, the entire front surface 120 is coated with, covered with, or even defined by the first mating element 124, which comprises a bed of loops or loop material. Meanwhile, the entire fastening portion 134 is coated with, covered with, or even defined by the second mating element 136, which is a bed of hooks or hook material that can removably mate with the bed of loops/loop material included in the first mating element 124.

However, in other embodiments, the first mating element 124 and the second mating element 136 may be or include any desirable mating elements. For example, first mating element 124 and second mating element 136 might include magnets, snap attachments (e.g., molded plastic couplers), or other such mating elements, in addition or in lieu of hook and loop fasteners to increase a weight bearing capacity of the attachment device 100. Moreover, in other embodiments, the first mating element 124 need not cover or define the entire front surface 120 and/or the second mating element 136 need not cover or define the entire fastening portion 134. For example, in some embodiments, the first mating element 124 may comprise a bed of loop material with portions of hook material embedded or included therein. The loop material would allow the first mating element 124 to mate with the second mating element 136 while the hook portions would allow the first mating element 124 to also removably engage additional beds of the loop material, such as those included on the closure of flaps of golf gloves. The hook portions could be interspersed with loop materials and/or organized in a pattern of varying sections.

Regardless of how the first mating element 124 and second mating element 136 are formed, when the fastening portion 134 is folded onto the front surface 120, the fastening portion 134 can mate with the first mating element 124 to form a removable coupling. The removable coupling can secure the attachment device 100 around an elongate support (e.g., around a roof support stanchion of a golf cart). In FIG. 1, the fastening portion 134 is disposed beneath area 123 and, thus, would fold over the first lateral side 112 and engage the first mating element 124 of the front surface 120 adjacent the first lateral side 112.

That all said, in some embodiments, the attachment device 100 need not include the first mating element 124 and second mating element 136. For example, the attachment device 100 could be integrally formed with, retrofitted into, or otherwise formed with an elongate support 202 of a golf travel device 200. For example, the attachment device 100 might be manufactured as part of a roof support stanchion for a golf cart or a grip or handle for a pull cart. In these embodiments, the attachment device 100 might have a higher weight capacity. Additionally or alternatively, to increase the weight capacity, the attachment device 100 might be an unopenable annular component made from only a grip portion 132 (described below) and the first engagement members 122 and, for example, could be slid onto an open end of open-ended elongate supports 202.

Still referring to FIGS. 2-4, in order to ensure that the attachment device 100 remains fixed in a particular location on an elongate support 202 of a golf travel device 200, the back surface 130 also includes a grip portion 132. The grip portion 132 may extend from the fastening portion 134 to the second lateral side 114 of the back surface 130, covering a majority of the back surface 130. The grip portion 132 may be comprised of a rubber or high friction material and may have a thickness T1 that is in a range of approximately 0.2-1.0 millimeters (mm), approximately 0.4-0.8 mm, or approximately 0.65-0.75 mm.

For example, the grip portion 132 may be formed from a embossed PVC, woven polyester material with a thickness of 0.72 mm, such as the MEGA GRIP II material produced by Top Value Fabrics, of Carmel, Ind. The thickness T1 of the grip portion 132 ensures that a strong connection is formed between the grip portion 132 and the elongate support 202 of a golf travel device 200, which, at least for golf carts, may be very smooth. For example, golf cart stanchions are often constructed of metal and coated in a glossy paint, which results in a very smooth surface, but the rubber or high friction material of grip portion 132, especially if it is the preferred thickness, will frictionally engage even this surface when tightened there against. In fact, due at least in part to the grip portion 132, the attachment device 100 may have the capacity to support at least 10 lbs. of total weight (the device plus attached accessories) without the slipping or otherwise changing positions, even when mounted on a vertically oriented elongate support 202.

In at least some embodiments, the grip portion 132 is directly coupled to a back of the first mating element 124. For example, the grip portion 132 may be sewn onto the back of a bed of loop material comprising the first mating element 124. The fastening portion 134 can also be directly coupled to a back of the first mating element 124 adjacent the grip portion 132 (and, thus, a seam may be present between the two). Consequently, the grip portion 132 and the fastening portion 134 are sometimes described herein as defining the back surface 130 and the first mating element 124 is sometimes described herein as defining the front surface 120.

Figure 5:
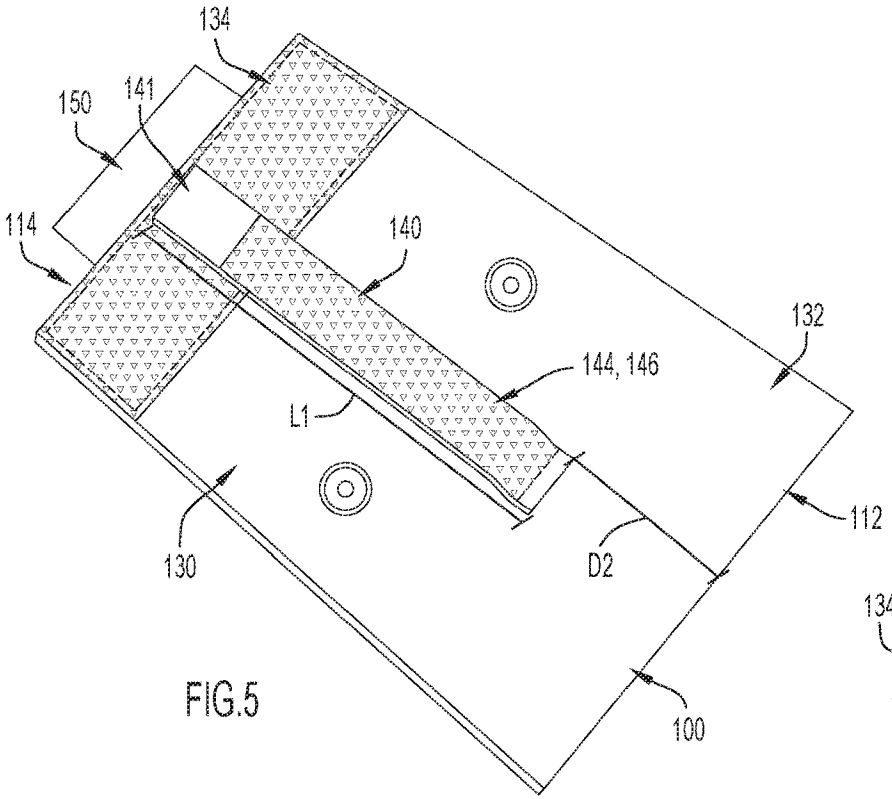

Now turning to FIGS. 5 and 6, in at least some embodiments, the attachment device 100 includes an installation strap 140 and/or a pull tab 150. The pull tab 150 may extend from the fastening portion 134 (or area 123 if viewed from the front) and may provide a place for a user to grasp when installing the attachment device 100 onto an elongate support 202 and/or removing the attachment device 100 from an elongate support 202. Meanwhile, the installation strap 140 may assist a user during installation of the attachment device 100 onto an elongate support 202.

Specifically, the installation strap 140 includes a front surface 142 and a back surface 144. When the installation strap 140 is lying flat against the back surface 130, the front surface 142 faces the back surface 130 and the back surface 144 of the installation strap 140 is exposed. The back surface 144 includes a third mating element 146 disposed over nearly an entirety of its length. In the depicted embodiment, the third mating element 146 includes a bed of hooks or hook material so that it can mate with the first mating element 124 (which is a bed of loops or loop material). However, in other embodiments, the third mating element 146 may include any components to allow the third mating element 146 to mate with the first mating element 124 and/or the second mating element 136.

The installation strap 140 extends from the back surface 130 and, more specifically, extends a length L1 from a location that is distance D2 from the first lateral side 112. Collectively, L1 and D1 span the overall width W1 of the attachment device 100; however, D1 is substantially shorter than half of width W1 so that L1 is substantially longer than half of width W1. Since L1 is substantially longer than D2, when a free end 141 of installation strap 140 is pulled towards first lateral side 112, it can extend substantially beyond the first lateral side 112 (as is partially shown in FIG. 6).

Overall, the installation strap 140 is relatively flexible. Specifically, the installation strap 140 does not include gripping material (like grip portion 132) and, thus, may be more flexible than the remainder of attachment device 100. Consequently, installation strap 140 may be easier, at least as compared to the front and back surfaces 120, 130 of attachment device 100, to wrap around an elongate support 202. That is, owing to the comparative flexibility of the installation strap 140 and the front and back surfaces 120, 130, more slack may be available when attaching the third mating element 146 of the installation strap 140 to the first mating element 124 than is available while mating the first mating element 124 to the second mating element 136. Thus, installation strap 140 might allow a user to easily temporarily install the attachment device 100 on an elongate support 202 while the user repositions themselves to gain leverage and tighten the attachment device before mating the first mating element 124 to the second mating element 136.

Figure 7B:
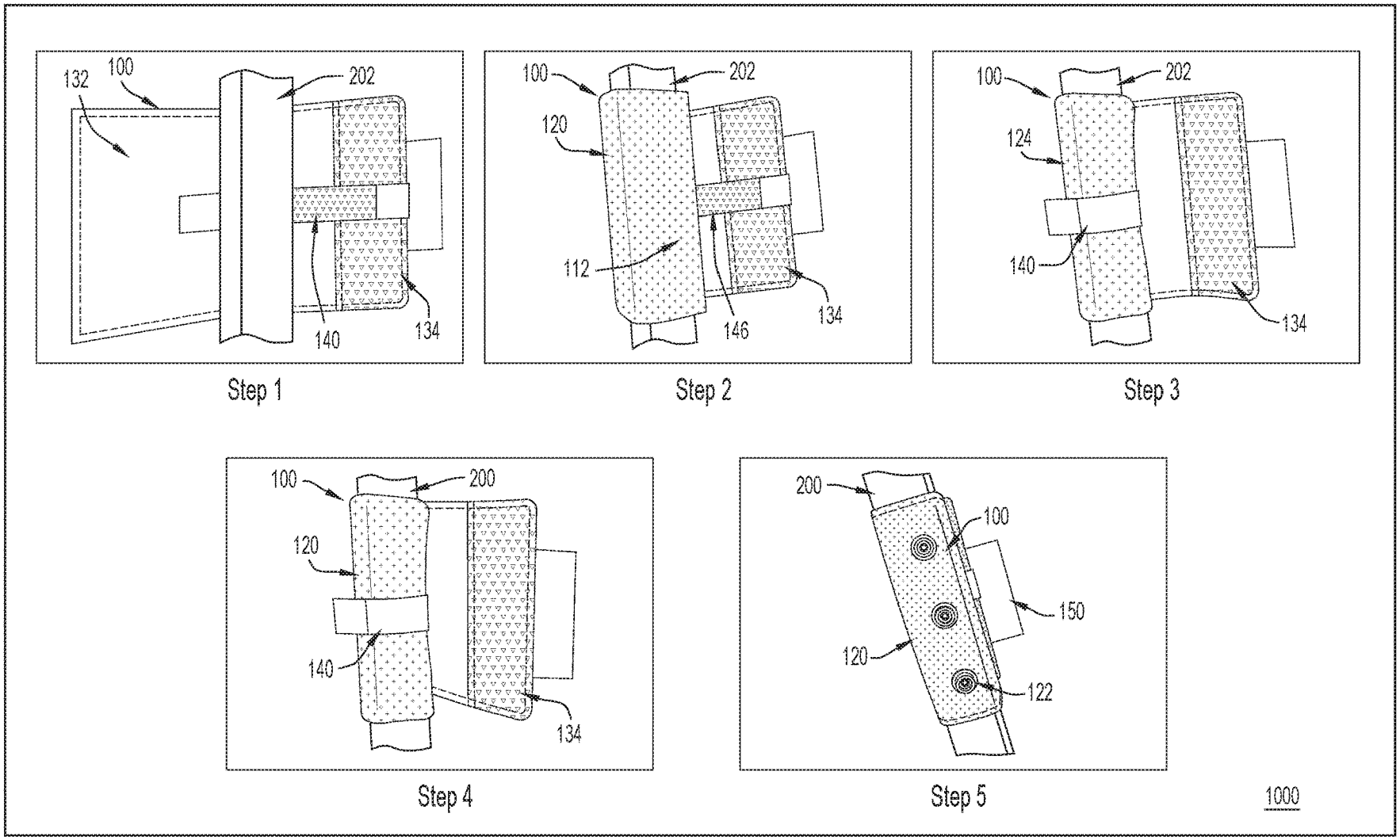
FIG. 7B depicts a method of securing the attachment device of FIG. 2 on an elongate support of a golf travel device.

FIG. 7A illustrates the attachment device 100 while installed on an elongate support 202 of a golf travel device 200 and FIG. 7B illustrates an example method of installation. In the embodiment illustrated in these two figures, the attachment device 100 is installed so that the first engagement members 122 are aligned on a front 2021 of the elongate support 202; however, the user could also install the attachment device 100 to align the first engagement members 122 with any face of the elongate support 202. Regardless, due to the dimensions and configuration of the attachment device 100, the first engagement members 122 align on a face of the elongate support 202 (instead of a corner) as the first mating element 124 is mated with the second mating element 136 to secure the grip portion 132 in frictional engagement with the elongate support 202. Additionally, since the front surface 120 of the depicted embodiment is entirely covered with first mating element 124, the first mating element 124 is exposed and is usable for attaching items with a corresponding mating element.

Moreover, due to the dimensions and configuration of the attachment device 100, the longitudinal axis A1 of the first engagement members 122 nearly bisects the elongate support 202. This may be advantageous for weight bearing and stability, at least because it centers the weight on the attachment device 100. Moreover, this positioning may make it easy for a user to remove or attach accessories to the attachment device 100 (since it a solid backing is behind the first engagement members 122) spacing. Notably, the pull tab 150 is available for easy grasping when the attachment device 100 is installed on the elongate support 202.

Generally, to secure the attachment device 100 to the elongate support 202, the back surface 130 is wrapped around the elongate support 202, pressing the grip portion 132 against the elongate support 202. Then, the back surface 130 is secured in place by connecting the mating element 134 (i.e., a fastening portion) of the back surface 130 to the mating element 124 (e.g., mating portion) of the front surface 120. This securing causes the grip portion 132 of the back surface 130 to frictionally engage the elongate support 202. Notably, without the grip portion 132, the attachment device 100 might slip, slide, or otherwise shift on the vertically oriented elongate support 202.

Alternatively, and now referring specifically to the method 100 illustrated in FIG. 7B, prior to the securing of the back surface 130 around the elongate support 202, the attachment device 100 can be temporarily secured around the elongate support 202 by connecting the installation strap 140 to the mating element 124 (e.g., mating portion) of the front surface 120. Specifically, in a first step, the back surface 130 of the attachment device 100 is held against an elongate support 202 of a golf travel device 200 with the first engagement members 122 aligned on a face of the elongate support 200. In this position, the grip portion 132 of the back surface, as well as the back surface 144 of the installation strap 140 are disposed against the elongate support 202. Then, in a second step, the attachment device 100 is wrapped around the elongate support 202 (e.g., around three sides of a square elongate support 202), bringing the first lateral side 112 towards the fastening portion 134 of the back surface 130.

In a third step, the installation strap 140 is wrapped around the elongate support 202, so that it extends over the front side 120 (past the first lateral side 112) and the third mating element 146 is mated with the first mating element 124 of the front surface 120. This at least temporarily secures the attachment device 100 on the elongate support 200 and allows the user to have greater leverage when tightening the remainder of the attachment device around the elongate support 202. That is, in the fourth step, the attachment device 100 is stable, so a user can pull tightly on the fastening portion 134 of the back surface 130 to wrap the fastening portion 134 over the first mating element 124 of the front surface 120. The, in a fifth step, the fastening portion 134 is mated the first mating element 124 to complete installation of the attachment device 100.

Still referring to FIGS. 7A and 7B, but now turning to FIGS. 8A-16 as well, regardless of how the attachment device 100 is installed, one or more attachment accessories (e.g., bag accessory 160, towel accessory 180, towel accessory 181, strap accessory 190, and/or strap accessory 191) may be attached to the attachment device 100 (e.g., via the engagement members 122) once the attachment device 100 is secured in place on an elongate support. These accessories may support or provide support for golf accessories, golf equipment, personal belongings, etc. on the elongate support 202 of any golf travel device 200.

Figure 8B:
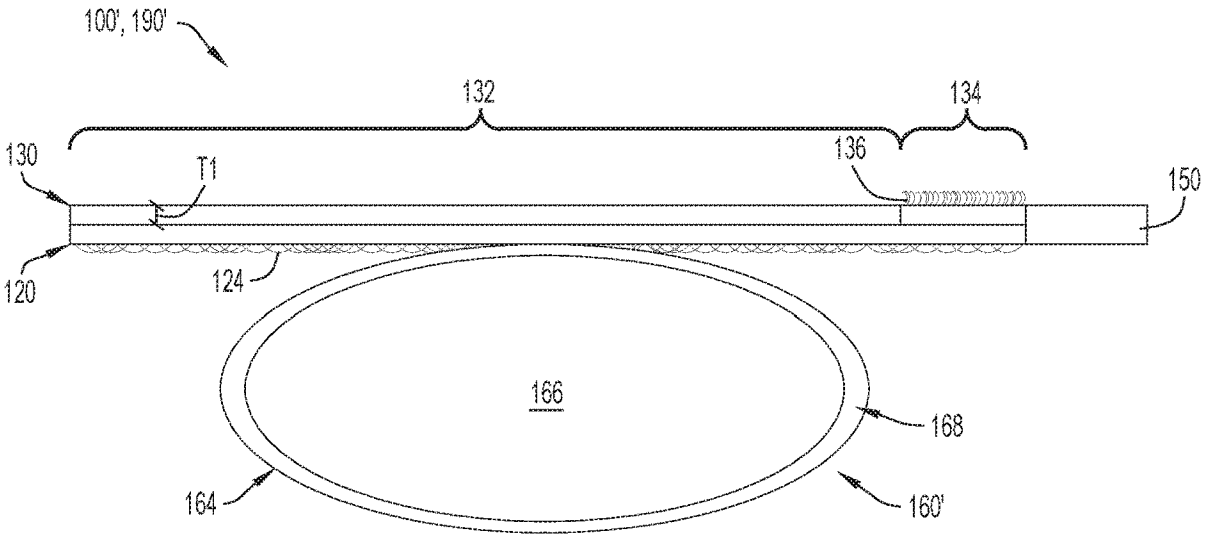
FIG. 8B is a top sectional view of a second embodiment of a bag accessory that may be included in the kit of golf accessories depicted in FIG. 1.
Figure 8A:
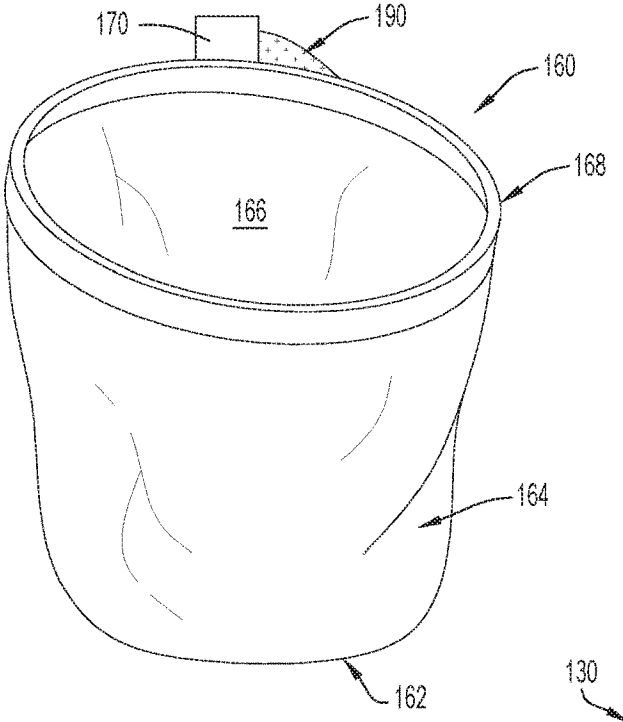
FIG. 8A is a perspective view of a first embodiment of a bag accessory included in the kit of golf accessories depicted in FIG. 1.

FIGS. 8A-12 illustrate the six different attachment accessories shown in FIG. 1 in more detail (kit 10 includes two first strap accessory 190 for a total of six attachment accessories). First, FIG. 8A shows the example embodiment bag accessory 160 from FIG. 1. The bag accessory 160 includes a bottom 162 bounded by sidewall 164. Collectively, the bottom 162 and sidewall 164 define an open-top receptacle 166. The sidewall 164 may also include or be coupled to a top rim 168 that keeps the receptacle 166 at least partially open. For example, the top rim 168 may be a resilient plastic rim that is biased to an open position or a stiff rim that remains open.

Thus, the top rim 168 may ensure that golf equipment/accessories stored within the receptacle 166, such as golf balls or tees, are easily viewable and accessible when stored therein. By comparison, golf accessories stored in a user's pocket must be identified by feel alone (e.g., without being seen) or by removing all of the accessories. The receptacle 166 may also be sufficiently deep to ensure that golf equipment/accessories stored within the receptacle 166 do not fall out during motion of the bag accessory 160 (e.g., as a golf cart drives). For example, the sidewall 164 may be at least 5 inches tall (e.g., approximately 6.5 inches tall) to provide a sufficiently deep receptacle 166.

The bag accessory 160 also includes fabric loops 170 that extend from the sidewall 164 and/or rim 168. The fabric loops 170 may include or support a second engagement member (not shown) that is configured to engage one of the first engagement members 122. Thus, the second engagement member may be a female portion of a ⅜ inch snap, a magnet of a specific polarity, a bed of loops and/or hooks, or any male or female engagement member now known or developed hereafter. In at least some of these embodiments, the second engagement member may be formed integrally with the bag accessory 160 and, thus, may be irremovable from the bag accessory 160. Alternatively, the fabric loops 170 might be closed loops that can receive a strap with a second engagement member included thereon, an example of which is described below in connection with FIG. 10. In these latter embodiments, the second engagement member may be formed integrally with the strap and may be irremovable from the strap.

Second, FIG. 8B illustrates a second embodiment of a bag accessory. Bag 160' is substantially similar to bag accessory 160 insofar as both define a bag (i.e., a bag component) with a bottom 162, one or more sidewalls 164, and a top rim 168 that define a receptacle 166. Thus, for brevity, these like aspects are not described in detail and it should be understood that any descriptions of these parts of first bag accessory 160 apply to the like parts of second bag accessory 160'. On the other hand, the main, if not only, difference between the two embodiments is how the bag accessories engage an elongate support 202. In the embodiment depicted in FIG. 8B, a bag component of the bag accessory 160' is irremovably connected (e.g., formed integrally with) an attachment component 100'/190' that can be mounted onto an elongate member 202 of a golf travel device 200. By comparison, in FIG. 8, the bag accessory 160 includes or is configured to connect to a second engagement member 182, such as one included on strap accessory 190.

For brevity and illustrative purposes, the attachment component 100'/190' is labeled as a modified version of strap 190 (modified strap 190') or a modified version of the attachment device 100 (modified device 100'). Moreover, and also for brevity, parts of the attachment component 100'/190' that are similar to parts of attachment device 100 are labeled with part numbers from the attachment device 100 and it should be understood that any descriptions of the parts of attachment device 100 apply to the like parts of attachment component 100'/190'. For example, the attachment component 100'/190' of bag accessory 160' may include a back surface 130 with a grip portion 132 of thickness T1 that can frictionally engage an elongate support 202 of a golf travel device 200. Likewise, the attachment component 100'/190' of bag accessory 160' includes a front surface 120 with a first mating element 124 while the back surface 130 includes a fastening portion 134 with a second mating element 136 that can removably mate with the first mating element 124. Thus, the attachment component 100'/190' can be wrapped around and tightened against an elongate support 202 of a golf stanchion to secure the bag accessory 160' thereto.

As is indicated by the labeling of the attachment component with part number 190', in some embodiments, the attachment component 100'/190' may more closely resemble the strap 190 (described below). For example, the attachment component 100'/190' may be relatively narrow and include a loophole through which one end of the attachment component 100'/190' may pass through before tightening (e.g., by folding backwards after passing through the loophole). However, in these embodiments, the strap 190' should still include a grip portion 132 on its back surface to allow frictional engagement with an elongate support 202 of a golf travel device 200.

That said, since the bag accessory 160' is formed integrally with the attachment component 100'/190', there may be no need for first engagement members 122 and second engagement members 182. Thus, the attachment component 100'/190' may only include such elements if it is intended to provide attachment points for additional accessories. For example, if the attachment component 100'/190' resembles strap 190, it may not include a second engagement members 182. Meanwhile, if the attachment component 100'/190' resembles attachment device 100, it need not include a first engagement member 122 between the sidewall 164 and the attachment component 100'/190', but may include one or more first engagement members 122 elsewhere (e.g., on front surface 120) to support additional attachment accessories thereon (e.g., the straps 190/191 and/or towels 180/181 presented herein).

Figure 9:
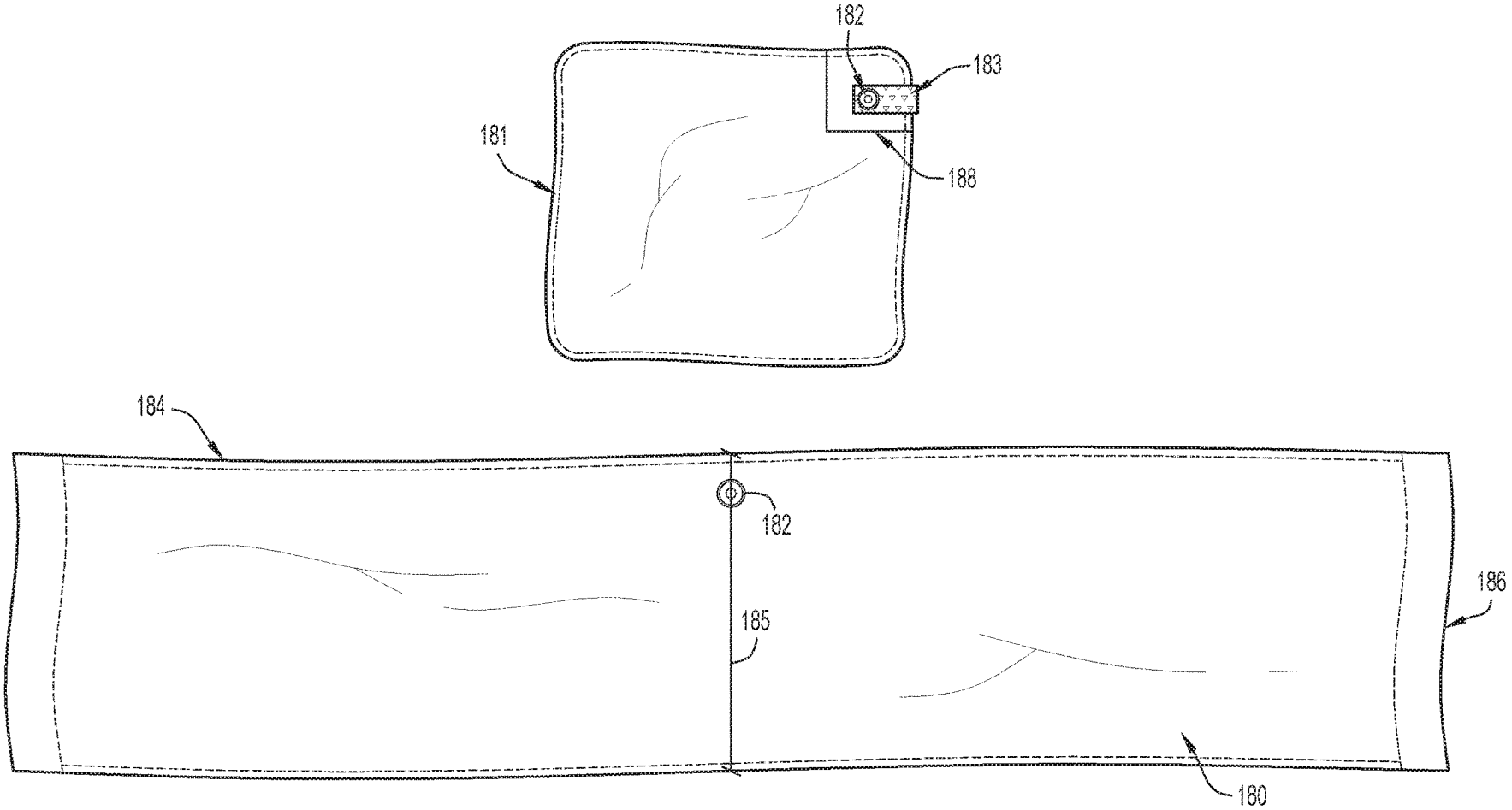
FIG. 9 is a top view of a first towel accessory and a second towel accessory included in the kit of golf accessories depicted in FIG. 1.

Third, FIG. 9 illustrates the first towel accessory 180. The first towel accessory 180 is a long, rectangular towel, with the rectangular shape being defined by major sides 184 (i.e., longer sides) and minor sides 186 (i.e., shorter sides). The first towel accessory 180 includes a second engagement member 182 (which may also be referred to as a third engagement member, but should be understood to be the same as the second member described above in connection with bag accessory 160) that is positioned along one of its major sides 184. Specifically, the second engagement member 182 is positioned at a midpoint 185 of the major sides 184, along an edge. Thus, when the first towel accessory 180 is connected to a first engagement member 122 of the attachment device 100, the first towel accessory 180 will naturally fold in half along its midpoint 185. The second engagement member 182 may be formed integrally with the first towel accessory 180 and, thus, may be irremovable from the first towel accessory 180.

Fourth, FIG. 9 also illustrates the second towel accessory 181. Second towel accessory 181 is smaller than first towel accessory 180 and is substantially square. These smaller towels are often used to clean balls before putts or for minor cleaning jobs. Thus, these smaller towel accessories 181 are often used on each and every hole and it is desirable to have easy access to as much of the second towel accessory 181 as possible. By comparison, large towels, like first towel accessory 180 may be used to intermittently clean club faces, club grips, a golfer's hands, etc. (e.g., to remove grass and/or sand) and, thus, there is no need to fold or carry the towel. Consequently, the second engagement member 182 of second towel accessory 181 is included in a corner 188 of the second towel accessory 181 (generally demarcated by a dashed line). The corner 188 also includes a fastening swatch 183 (e.g., a swath of hook material) that allows the towel accessory 181 to be quickly attached to and removed from the attachment device 100 (e.g., quicker than via the second engagement member 182).

That is, since the engagement member 182 is disposed adjacent or atop the fastening swatch 183, the corner 188 of the second towel accessory 181 can be attached to the attachment device 100 via either item. Specifically, the engagement member 182 can be removably coupled to one of the first engagement members 122 of the attachment device 100. Additionally or alternatively, the fastening swatch 183 can be mated with the first mating element 124 of the front surface 120 of the attachment device 100. For example, the fastening swatch 183 may be or includes a bed of hooks or hook material so that it can mate with the first mating element 124 (which is a bed of loops or loop material). In at least some embodiments, the second engagement member 182 and/or the fastening swatch 183 may be formed integrally with the second towel accessory 181 (and/or each other) and, thus, may be irremovable from the second towel accessory 181.

Figure 10:
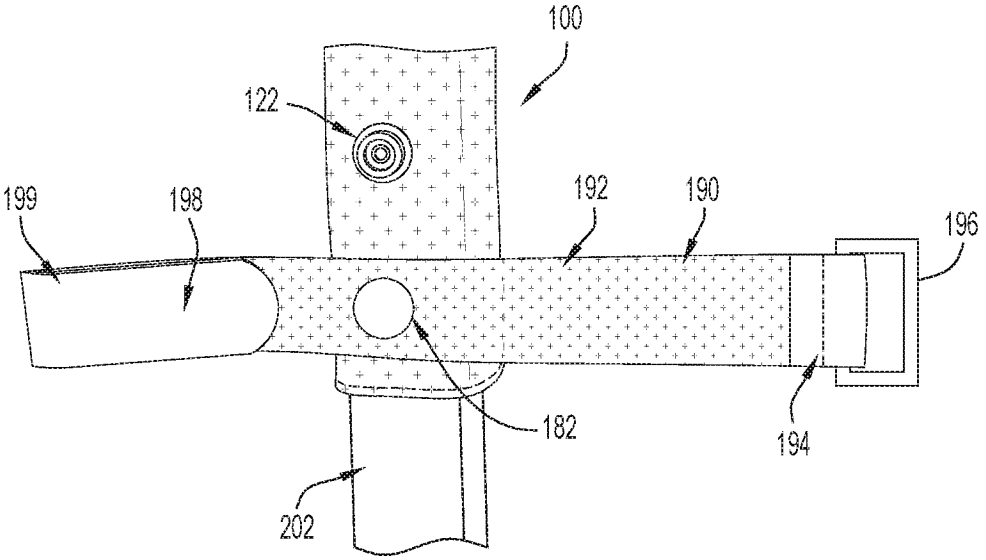

Fifth, FIG. 10 illustrates the first strap accessory 190. The first strap accessory 190 is adjustable and also includes a second engagement member 182 to allow the first strap accessory 190 to be coupled to one of the first engagement members 122 of the attachment device 100. The second engagement member 182 of the first strap accessory 190 may also be irremovable from its accessory. The first strap accessory 190 extends from a first end 194 to a second end 198 and includes a mating area 192 defined on at least one of the surfaces extending therebetween. The first end 194 includes a mating portion 199 and the second end 198 includes a loophole 196 (e.g., a plastic piece defining a fixed opening). Thus, the mating portion 199 can be inserted into the loophole 196 and then coupled to the mating area 192 to form a closed loop of adjustable size. In some instances, the mating portion 199 is folded back after passing through the loophole 196, but it can also connect without folding (e.g., like a belt). Like mating elements 124, 136 of the attachment device 100, mating portion 199 and mating area 192 can include any desirable mating elements, such as hook and loop material, magnets, snap attachments, or other such mating elements.

Figure 11:
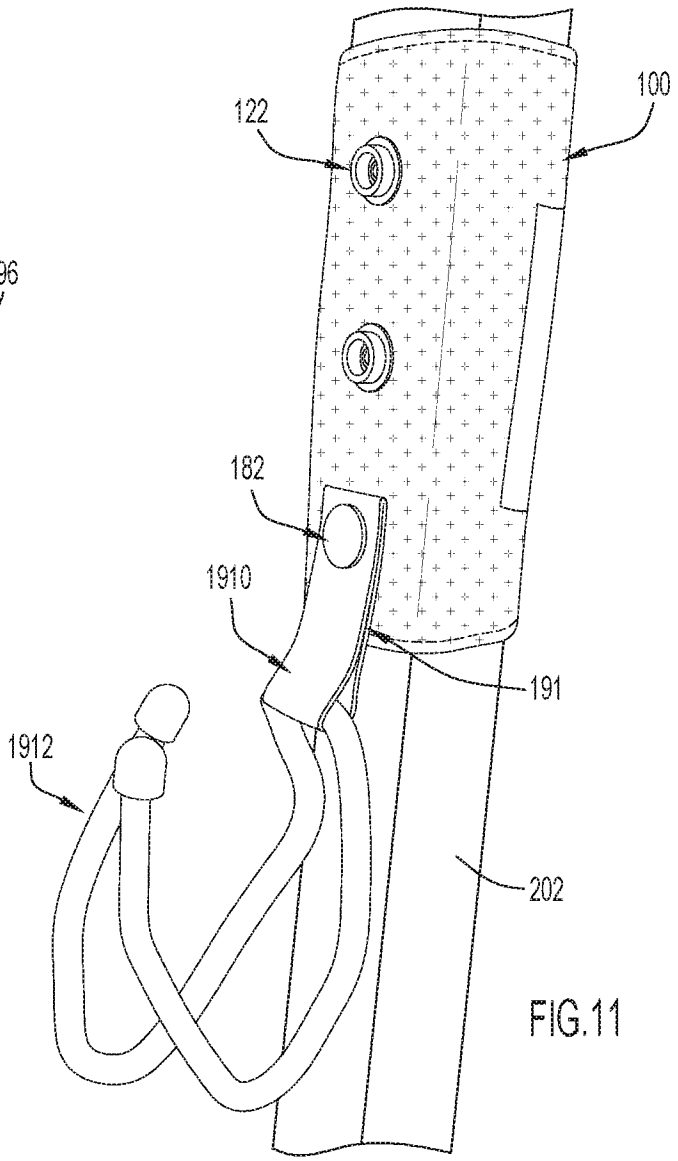
FIGS. 10 and 11 are perspective views of a first strap accessory and a second strap accessory, respectively, included in the kit of golf accessories depicted in FIG. 1.

Sixth, FIG. 11 illustrates the second strap accessory 191. The second strap accessory 191 has a closed, unopenable loop 1910 of a fixed size and a second engagement member 182 that is irremovable from second strap accessory 191. The second strap accessory 191 may also be significantly shorter than the first strap accessory 190 and may extend in one direction from the second engagement member 182. Thus, the second strap accessory 191 may be well suited to support additional accessories, such as a club support 1912 or a carabineer 1914 (see FIG. 12). Notably, the club support 1912 may include two flexible arms that can be bent around a golf club, such as a putter, to support the golf club against the elongate support 202, so that the club is easily accessible for the golfer (which is important for a frequently used club, like a putter). Also, many golfers are quite particular about their putter (or other clubs) and try to take special care of their putter (e.g., with putter covers). Storing a putter in the flexible club support 1912 may separate the putter (or another club) from other golf clubs stored in a golf bag, thereby preventing damage to the club (e.g., from clubs banging together).

Figure 12:
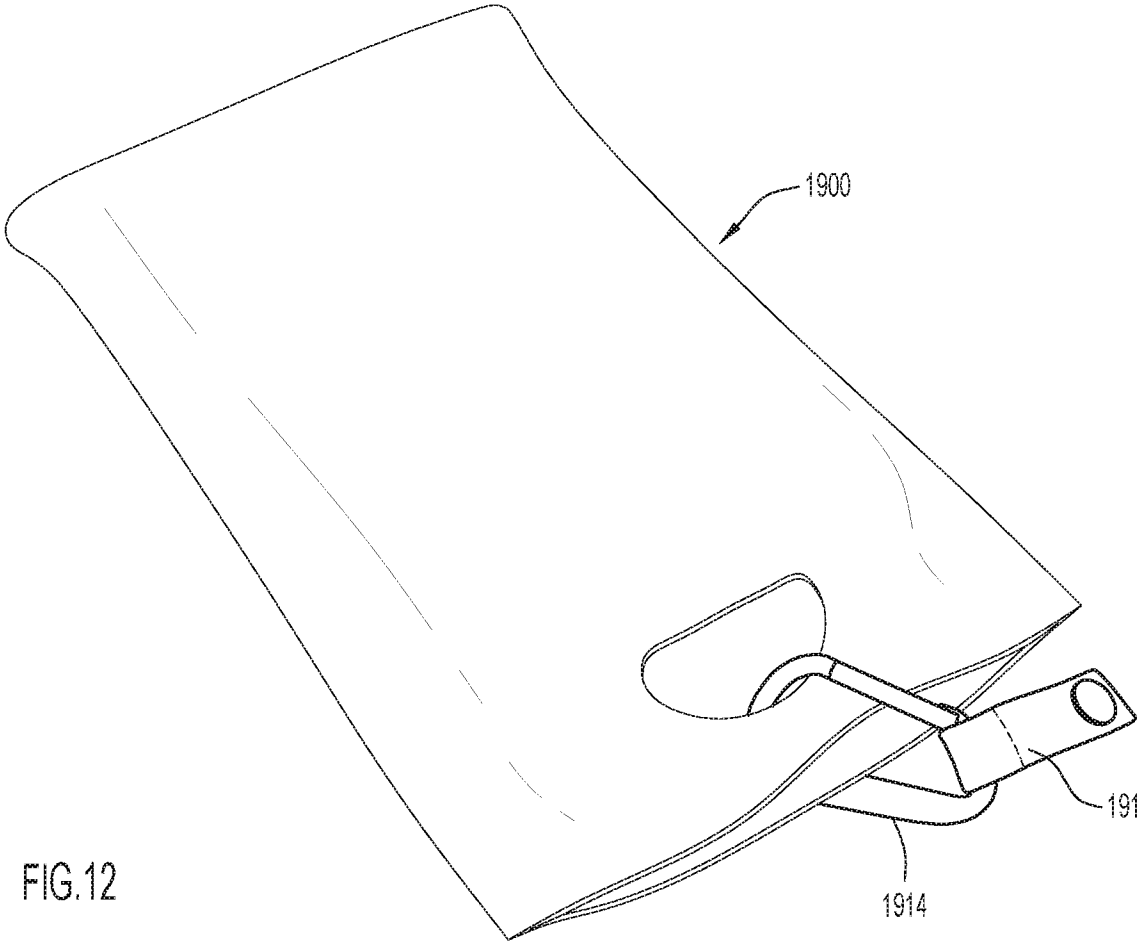
FIG. 12 is a perspective view of the kit of golf accessories depicted in FIG. 1 while packaged in product packaging.

FIG. 12 shows an additional use for a carabineer 1914 attached to the second strap accessory 191. Here, the carabineer 1914 and second strap accessory 191 are used to close packaging 1900 for the golf accessories kit 10. By using the carabineer 1914 and second strap accessory 191, costs associated with procuring and/or manufacturing a closure element are foregone. This also reduces waste.

Figure 13:
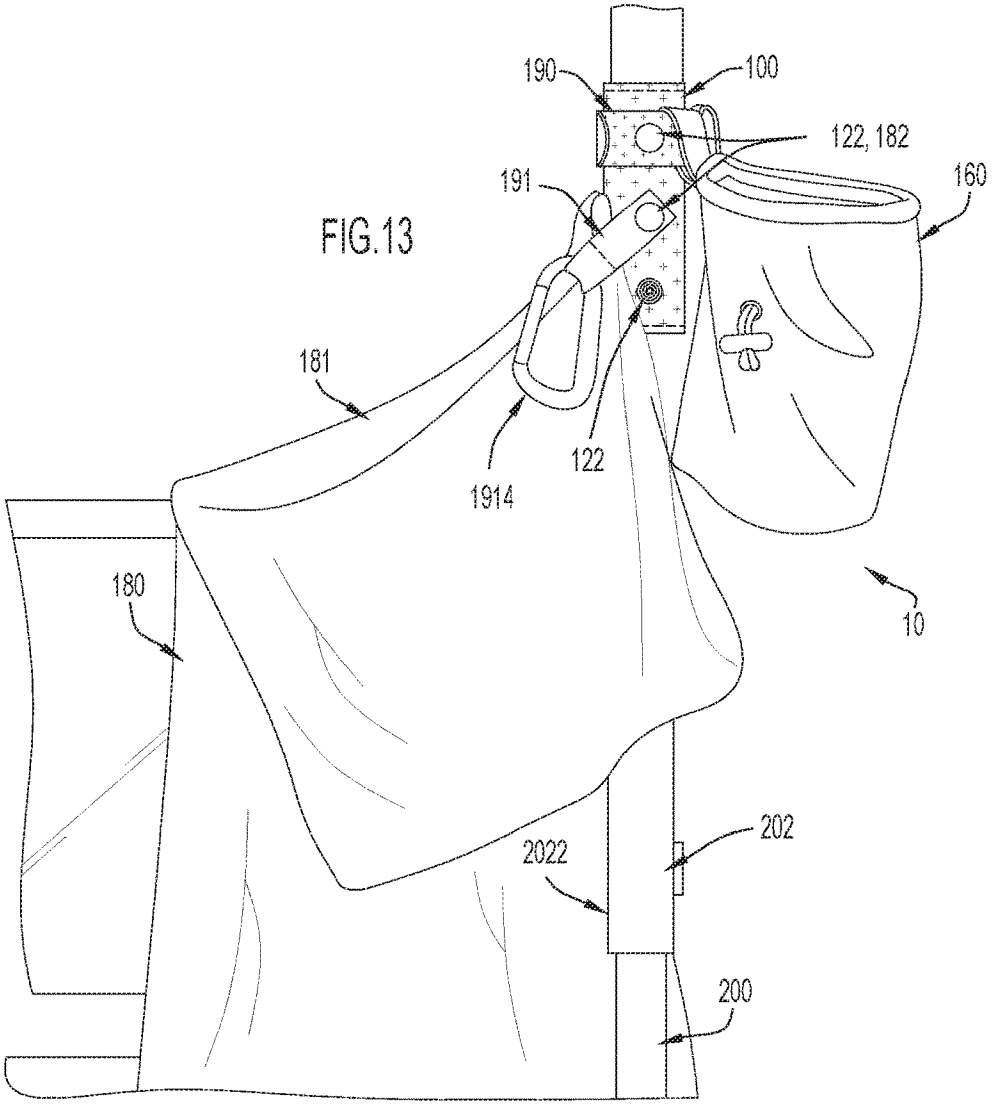
FIGS. 13-16 are perspective views of various embodiments of a kit of golf accessories, formed from combinations of the accessories depicted in FIG. 1, while installed on a golf travel device.

FIGS. 13-16 show golf accessories kits 10 formed with different combinations of the attachment accessories presented herein being used on a golf travel device 200. In FIG. 13, the second engagement member 182 of the first strap accessory 190 is attached to the uppermost first engagement member 122 to secure the bag accessory 160 to the attachment device 100. Then, the second engagement member 182 (which may also be called the third engagement member 182) of the second strap accessory 191 is secured to the middle first engagement member 122. The bottommost first engagement member 122 is open and available for use because the first towel accessory 180 has been temporarily removed from its first engagement member 122 and has been draped over a windshield of the golf travel device 200 in FIG. 13 (perhaps for use). Additionally, in FIG. 13, second towel accessory 181 has been stuck to the first mating element 124 of the front surface 120 by removably mating the fastening swatch 183 of the second towel accessory 181 with the first mating element 124. In this instance, the attachment device 100 is installed on the elongate support 202 while the first engagement members 122 were aligned with the back 2022 of the elongate support 202.

Figure 14:
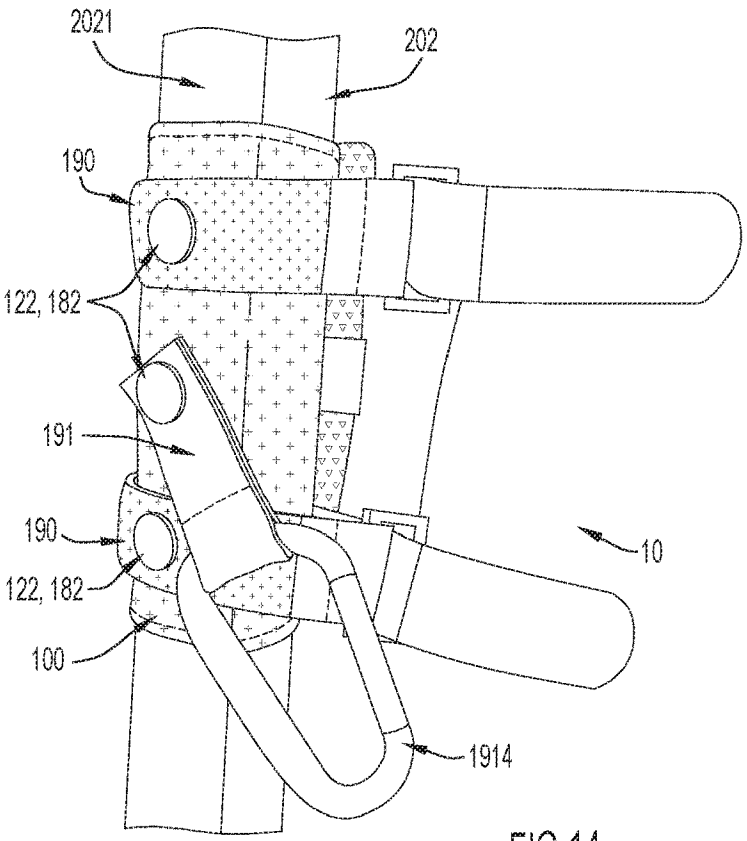

In FIG. 14, the attachment device 100 is installed on the elongate support 202 with the first engagement members 122 are aligned with the front 2021 of the elongate support 202. In this instance, two of the first strap accessories 190 and one of the second strap accessory 191 have been connected to the attachment device 100.

Figure 15:
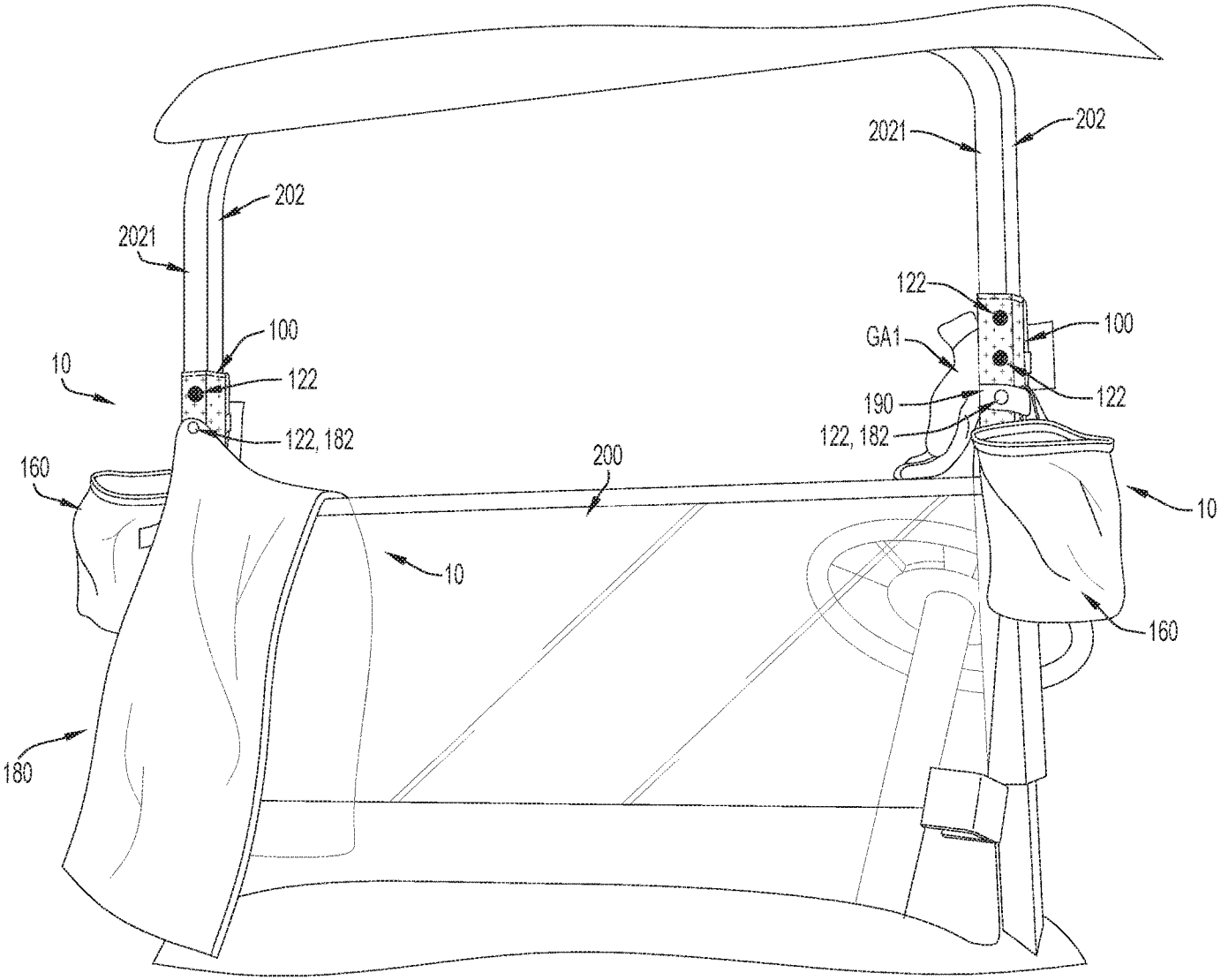
Figure 16:
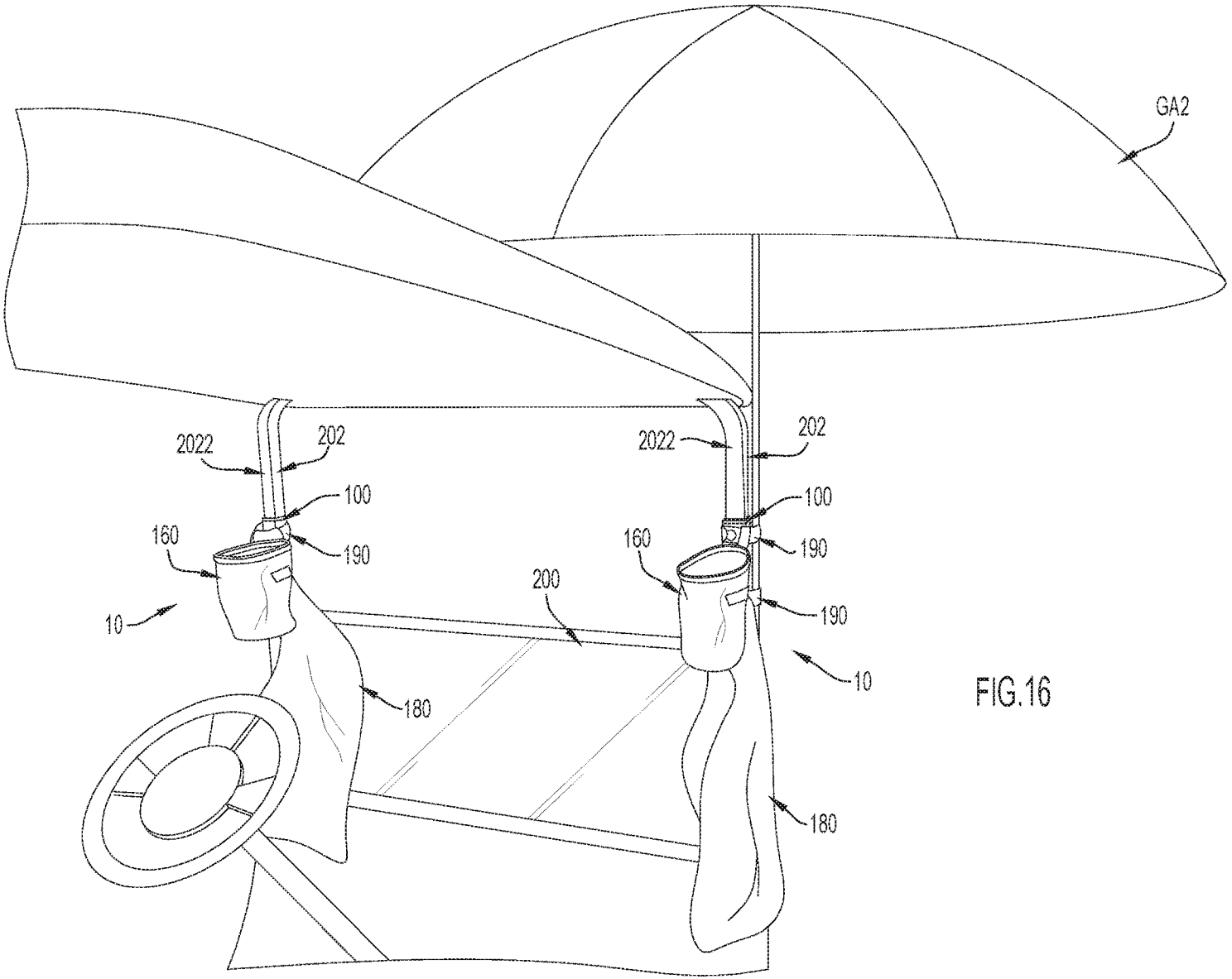

In FIGS. 15 and 16, attachment devices 100 have been installed on both front elongate supports 202 of a golf travel device 200 (e.g., both stanchions of a golf cart), so that two players riding in the golf travel device 200 can store their belonging/accessories/equipment on separate elongate supports 202. In one side (the driver side) of the golf travel device 200 shown in FIG. 15, a user has attached a bag accessory 160 to the attachment device 100 by attaching a second engagement member 182 of first strap accessory 190 to the lowermost first engagement member 122 after feeding the first strap accessory 190 through loops 170 of the bag accessory 160. Additionally, the user/player has secured golf glove GA1 to the first mating element 124 of the front surface 120 of the front surface 120 (e.g., with hook and loop connections). Meanwhile, on the other side (the passenger side), a user has connected a bag accessory 160 and a first towel accessory 180 to the attachment device 100 by attaching second engagement members 182 of a first strap accessory 190 and a first towel accessory 180 to the lowermost and middle first engagement members 122, respectively. Both attachment devices 100 are secured with the first engagement members 122 oriented on a front face 2021 of an elongate support 202.

In FIG. 16, both sides of the golf travel device 200 have a bag accessory 160 and a first towel accessory 180 attached to the attachment device 100. The first towel accessories 180 are attached by connecting the second engagement members 182 included therein to first engagement members 122. Meanwhile, the bag accessories 160 are attached by feeding a first strap accessory 190 through the fabric loops 170 and attaching the second engagement member 182 of the first strap accessory 190 to the first engagement members 122 of the attachment device 100, like in FIG. 15. Additionally, on the driver side, a user has attached a second first strap accessory 190 to the attachment device 100 and is using the pair of first strap accessories 190 (one from the bag accessory 160 and one installed independently) to secure an umbrella accessory GA2 to the elongate support 202. In FIG. 16, both attachment devices 100 are secured with the first engagement members 122 oriented on a back face 2022 of an elongate support 202.

Figure 17:
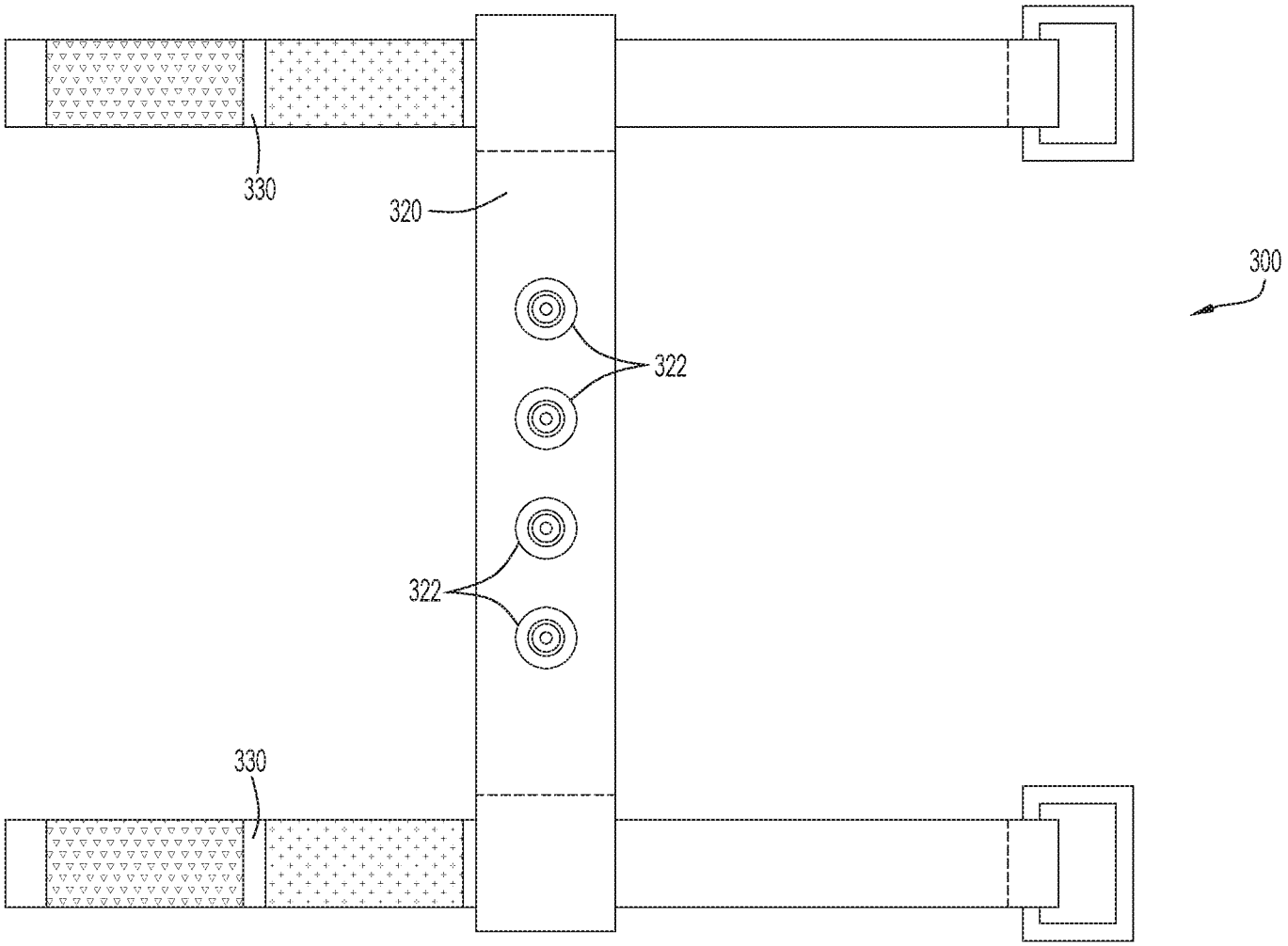
FIG. 17 depicts a second embodiment of an attachment device that may be included in the kit of golf accessories presented herein.

Now turning to FIG. 17, this figure illustrates a second embodiment of an attachment device that can be included in the golf accessories kit 10 presented herein. The second embodiment 300 includes first engagement members 322 that are similar to the first engagement members 122 described above and, thus, any description of first engagement members 122 should be understood to apply to first engagement members 322. However, now, the first engagement members 322 are included on a main strip 320 that is connected, at both of its longitudinal ends, to connecting straps 330. When the connecting straps are tightened around am elongate support 202 of a golf travel device 200, the main strap 320 extends longitudinally along the elongate support 202 and provides access to the first engagement members 322 in a similar manner to how the attachment device 100 provides access to first engagement members 122.

The connecting straps 330 may have a back surface with a grip portion (not shown) that is similar to the grip portion 132 described above in connection with attachment device 100 and, thus, any description of grip portion 132 should be understood to apply to the connecting straps 330. Additionally, the connecting straps may be similar to the first strap accessory 190 in that the connecting straps 330 may include loopholes, mating areas, and mating portions to allow the connecting straps 330 to form closed loops of adjustable sizes. For brevity, the connecting straps 330 are not described in detail and it should be understood that the description of parts of first strap accessory 190 applies to like parts of connecting straps 330.

While the golf kit and golf accessory devices presented herein have been illustrated and described in detail and with reference to specific embodiments thereof, it is nevertheless not intended to be limited to the details shown, since it will be apparent that various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

It is also to be understood that the golf kit and golf accessory devices described herein, or portions thereof may be fabricated from any suitable material or combination of materials unless the material, such as plastic, foamed plastic, wood, cardboard, pressed paper, metal, supple natural or synthetic materials including, but not limited to, cotton, elastomers, polyester, plastic, rubber, derivatives thereof, and combinations thereof. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, ethylene-vinyl acetate (EVA), or the like. Suitable foamed plastics may include expanded or extruded polystyrene, expanded or extruded polypropylene, EVA foam, derivatives thereof, and combinations thereof.

Finally, it is intended that the present application cover the modifications and variations of this application that come within the scope of the appended claims and their equivalents. For example, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present application to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment.

Similarly, when used herein, the term "comprises" and its derivations (such as "comprising", etc.) should not be understood in an excluding sense, that is, these terms should not be interpreted as excluding the possibility that what is described and defined may include further elements, steps, etc. Meanwhile, when used herein, the term "approximately" and terms of its family (such as "approximate," etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about" and "around" and "substantially."

The invention claimed is:

1. A kit of golf accessories, comprising:

an attachment device sized to wrap around and removably engage an elongate support of a golf travel device, the attachment device including:

a planar first side with a grip portion configured to frictionally engage the elongate support of the golf travel device when the attachment device is wrapped around and secured to the elongate support;

a planar second side that is opposite the planar first side and includes a plurality of first engagement members arranged in longitudinal alignment on the planar second side; and an installation strap extending from a central, non-edge portion of the planar first side, the installation strap including a mating element that can removably mate with the planar first side or the planar second side to temporarily secure device around the elongate support of the golf travel device; and a bag accessory including a closed bottom and at least one sidewall that define a receptacle, the receptacle including a second engagement member configured to engage with one of the plurality of first engagement members.

2. The kit of claim 1, wherein the second engagement member is included on a strap that is removably coupled to one or more fabric loops that extend from the at least one sidewall or a top rim of the bag accessory.

3. The kit of claim 1, further comprising:

a towel accessory including a third engagement member configured to engage with one of the plurality of first engagement members, the third engagement member being irremovable from the towel accessory.

4. The kit of claim 3, wherein the third engagement member is included in a corner of the towel accessory.

5. The kit of claim 3, wherein the third engagement member is included at a midpoint of an edge of the towel accessory.

6. The kit of claim 1, further comprising:

a strap accessory including a third engagement member configured to engage with one of the plurality of first engagement members, the third engagement member being irremovable from the strap accessory.

7. The kit of claim 6, wherein the strap accessory is adjustable and includes:

a mating area;

a first end defining a loophole; and a second end configured to be inserted through the loophole and fold back onto the mating area to mate with the mating area and define a closed loop of adjustable size.

8. The kit of claim 6, wherein the strap accessory defines an unopenable closed loop of a fixed size through which additional accessories may be installed.

9. The kit of claim 1, wherein the grip portion of the attachment device is or is coated with a rubber material that has that provides frictional resistance against metal, wood, and plastic, the rubber material having a thickness in a range between 0.2 mm and 0.5 mm, inclusive of 0.2 mm and 0.5 mm.

10. The kit of claim 1, wherein the attachment device further comprises:

a fastening portion disposed on the planar first side, the fastening portion configured to removably mate with a portion of the planar second side to removably secure the attachment device on and around the elongate support.

11. A device for organizing a plurality of golf accessories, comprising:

a front planar surface including a first mating element;

a back planar surface, opposite the front planar surface, including:

a grip portion configured to wrap around an elongate support of a golf travel device; and a fastening portion including a second mating element configured to removably mate with the first mating element to removably secure the grip portion in frictional engagement with the elongate support of the golf travel device around which it is wrapped;

a plurality of first engagement members arranged in longitudinal alignment on the front planar surface that are configured to removably support a variety of golf accessories that include or are supported in attachable accessories with at least one second engagement member that can removably engage at least one of the plurality of first engagement members; and an installation strap extending from a central, non-edge portion of the back planar surface, the installation strap including a third mating element that can removably mate with the first mating element or the second mating element to temporarily secure device around the elongate support of the golf travel device.

12. The device of claim 11, wherein the grip portion is or is coated with a rubber material that provides frictional resistance against metal, wood, and plastic, the rubber material having a thickness in a range between 0.2 mm and 0.5 mm, inclusive of 0.2 mm and 0.5 mm.

13. The device of claim 11, wherein the first mating element comprises a bed of loop material or a bed of hook material and the second mating element comprises an other of the bed of loop material or the bed of hook material, so that the first mating element can removably mate with the second mating element.

14. The device of claim 13, wherein the first mating element comprises the bed of hook material or comprises the bed of loop material with portions of hook material embedded therein so that the first mating element can mate with the second mating element and also removably engage additional beds of loop material.

15. The device of claim 11, wherein the plurality of first engagement members includes male portions of standard ⅜ inch snaps and the at least one second engagement member is a female portion of the standard ⅜ inch snaps.

16. The device of claim 11, wherein the device is configured to wrap around an axis of the elongate support of the golf travel device and the plurality of first engagement members are approximately laterally centered on the front planar surface so that the plurality of first engagement members are spaced along a second axis that extends parallel to the axis of the elongate support.

17. The device of claim 16, wherein the device has a lateral dimension of approximately 7.375 inches and the plurality of first engagement members are disposed approximately 3.75 inches from a lateral edge of the device.

18. A device for organizing a plurality of golf accessories, comprising:

a planar attachment component including:

a first mating element disposed on a first side of the planar attachment component;

a grip portion disposed on a second side of the planar attachment component and configured to wrap around an elongate support of a golf travel device, the second side being opposite the first side;

a fastening portion disposed on the second side of the planar attachment component and including a second mating element configured to removably mate with the first mating element to removably secure the grip portion in frictional engagement with the elongate support of the golf travel device around which it is wrapped; and an installation strap extending from a central, non-edge portion of the second side of the planar attachment component, the installation strap including a third mating element that can removably mate with the first mating element or the second mating element to temporarily secure device around the elongate support of the golf travel device; and a bag component including a closed bottom and at least one sidewall that define a receptacle.

19. The device of claim 18, wherein the bag component is irremovably connected to the planar attachment component.

* * * * *